US010576022B2

(12) United States Patent
Shastri et al.

(10) Patent No.: US 10,576,022 B2
(45) Date of Patent: Mar. 3, 2020

(54) FEEDING BOTTLE DEVICE

(71) Applicant: KONINKLIJKE PHILIPS N.V., Eindhoven (NL)

(72) Inventors: Narasimha Shastri, Eindhoven (NL); Theodoor Stolk, Langezwaag (NL); Arnold Aalders, Sprang Capelle (NL); Jacob Cornelis Paul Den Dulk, Eindhoven (NL); Johannes Tseard Van Der Kooi, Munein (NL); Marijn Kessels, Nuenen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/336,977

(22) PCT Filed: Mar. 8, 2018

(86) PCT No.: PCT/EP2018/055754
§ 371 (c)(1),
(2) Date: Mar. 27, 2019

(87) PCT Pub. No.: WO2018/162639
PCT Pub. Date: Sep. 13, 2018

(65) Prior Publication Data

US 2019/0380915 A1 Dec. 19, 2019

(30) Foreign Application Priority Data

Mar. 9, 2017 (EP) ..... 17160136

(51) Int. Cl.
*A61J 9/04* (2006.01)
*A61J 11/00* (2006.01)
*A61J 11/04* (2006.01)

(52) U.S. Cl.
CPC ..... *A61J 9/04* (2013.01); *A61J 11/002* (2013.01); *A61J 11/008* (2013.01); *A61J 11/04* (2013.01)

(58) Field of Classification Search
CPC ..... A61J 1/2072; A61J 1/2037; A61J 11/001; A61J 11/002; A61J 9/04; B65D 35/22; B65D 35/222
(Continued)

(56) References Cited

U.S. PATENT DOCUMENTS

2004/0089626 A1* 5/2004 Pyun ..... A61J 9/006 215/11.5
2005/0023635 A1* 2/2005 Mouli ..... H01L 27/14601 257/510
(Continued)

FOREIGN PATENT DOCUMENTS

CN 2642305 Y 9/2004
DE 202005011998 U1 10/2005
(Continued)

*Primary Examiner* — J. Gregory Pickett
*Assistant Examiner* — Tia Cox

(57) ABSTRACT

The present invention relates to a feeding bottle device (100) comprising at least one air vent valve (140) for allowing the passage of air from outside the feeding bottle device (100) to within a container volume (125) when the feeding bottle device (100) is assembled, a confined volume forming component (150) for defining a confined volume (155) within a container volume (125) of a container component (120) of the feeding bottle device (100), wherein the confined volume (155) is configured to provide a controlled opening (165) for air entering through the air vent valve (140) into the container volume (125), and an optional duct forming component (170) for forming a guidance duct (175) from the at least one air vent valve (140) to the confined
(Continued)

volume (155). The feeding bottle device (100) reduces the risk of colic-like symptoms for an infant.

14 Claims, 7 Drawing Sheets

(58) Field of Classification Search
USPC ..... 215/11.4, 11.5
See application file for complete search history.

(56) References Cited

U.S. PATENT DOCUMENTS

| | | | | |
|---|---|---|---|---|
| 2009/0314734 | A1* | 12/2009 | Pfenniger | A61J 11/0015 215/11.1 |
| 2014/0124469 | A1* | 5/2014 | Richard | A61J 11/02 215/11.5 |
| 2016/0262198 | A1 | 9/2016 | Gardner | |
| 2016/0262985 | A1* | 9/2016 | Fan | A61J 9/0623 |

FOREIGN PATENT DOCUMENTS

| | | | |
|---|---|---|---|
| WO | 1997005853 | A1 | 2/1997 |
| WO | 2008123744 | A1 | 10/2008 |
| WO | 2011100416 | A1 | 8/2011 |

* cited by examiner

FEEDING BOTTLE DEVICE

This application is the U.S. National Phase application under 35 U.S.C. § 371 of International Application No. PCT/EP2018/0055754, filed on Mar. 8, 2018, which claims the benefit of International Application No. 17160136.2, filed Mar. 9, 2017. These applications are hereby incorporated by reference herein.

FIELD OF THE INVENTION

The invention relates to a feeding bottle device. The invention relates in particular to a feeding bottle device for feeding an infant. It finds application in the field of collecting, guiding and collapsing bubbles generated from an air venting valve in the feeding bottle device, wherein it also applies to other fields.

BACKGROUND OF THE INVENTION

Colic is a condition some infants suffer from during early months after birth, wherein presence of air in the digestive system is indicated as a major cause. Air ingestion is unavoidable both in breast-feeding and bottle-feeding due to the presence of vacuum in the infant's mouth during feeding. However, it is desired to reduce the amount of air ingested by the infant in order to prevent or alleviate colic-like symptoms.

Different strategies are used to minimize air ingestion during feeding, including reducing the effort required by the infant, for instance by reducing the vacuum through providing a venting valve in the bottle. However, in certain designs, since the venting valve opens under the liquid level for the majority of the feed, air entering into the bottle through the venting valve leads to the formation of bubbles within the liquid.

Presence of bubbles increases the chance of some bubbles being carried into the teat and thus eventually arriving in the mouth of the infant. A large number of small bubbles can provide a high surface to volume ratio which eventually can result in a higher dissolution of air within the milk. In addition, bubbling of air through milk potentially can reduce the nutritive value of milk by oxidation of certain nutrients. Further, the bubbles accumulate on the free surface of the liquid within the feeding bottle creating a foam that can be perceived negatively by some caregivers.

US 2016/02621985 discloses a vented baby bottle and comprises a bottle, a nipple, a mounting ring, and a vent assembly. Aeration (gas bubbles) in the bottle's fluid is decreased by establishing an air passage through the mounting ring into the interior of the bottle. When this air passage is used in combination with a vent assembly having a self closing vent valve, the system allows atmospheric air to vent into the interior of the baby bottle when a lower than atmospheric pressure is created within the bottle, thereby preventing the aeration of the fluid contained in the bottle.

SUMMARY OF THE INVENTION

It has therefore been an object of the present invention to provide a feeding bottle device which reduces the risk of colic-like symptoms for the infant.

In one aspect, a feeding bottle device is provided, wherein the feeding bottle device comprises a teat component defining a teat volume therein, a container component defining a container volume therein, and an attachment component. The teat component and the container component are attachable to each other along a contact area by means of the attachment component. The feeding bottle device further comprises at least one air vent valve for allowing the passage of air from outside the feeding bottle device to within the container volume when the feeding bottle device is assembled, and a confined volume forming component for defining a confined volume within the container volume, wherein the confined volume is configured to provide a controlled opening into the container volume for air entering through the air vent valve. The confined volume is formed by the confined volume forming component and a wall of the container volume in an assembled state of the feeding bottle device.

Since the confined volume provides a controlled opening into the container volume, air entering through the air vent valve is guided to the confined volume and only then released into the container volume in a controlled manner through the controlled opening. Air entering through the air vent valve can thus be guided to a preferred location, the confined volume, where bubbles, which potentially are formed, will be retained. These bubbles are accordingly collected and retained separate from the container volume within the confined volume and air will only be released into the container volume after being held away from the, for example, milk in the container volume for a longer time, which increases a probability of a collapsing of the bubbles. The controlled opening preferably defines the controlled release through the pre-defined design of the opening to a certain dimension. However, in other embodiments, also an active action to perform the controlled release can be implemented.

Further, since the confined volume is formed by the confined volume forming component and a wall of the container volume in an assembled state of the feeding bottle device, a confined volume can be achieved in the assembled state while there is no need for the confined volume forming component alone to present a closed volume or shape, which would be difficult to access, for instance for cleaning and desinfection purposes. In other words, the wall of the contained volume forming part of the confined volume, e.g. forming at least part of a surface delimiting the confined volume, allows for the confined volume forming component to be provided with an advantageous shape. The volume will then eventually become confined through assembly of the feeding bottle device.

A shape of the confined volume forming component can be designed such as to fit to the shape of the wall of the container volume to form a confined volume therebetween. For instance, the shape of the confined volume forming component can comprise a U-shape, while a V-shape and any other suitable shape is contemplated. An open, such as U-shaped, space is preferred since cleaning and disinfection is facilitated. However, in other embodiments the confined volume can also be formed by the confined volume forming component alone or in combination with a different component, provided the confined volume forming component participates in this formation.

Preferably, the dimensions of the confined volume forming component are larger than the corresponding dimensions of the container component in an un-assembled state. Thereby, a good sealing between the confined volume forming component and the container component can be formed in the assembled state.

In an embodiment the feeding bottle device further comprises a duct forming component for forming a guidance duct from the at least one air vent valve to the confined volume.

Since the duct forming component forms a guidance duct from the at least one air vent valve to the confined volume, air entering through the air vent valve at an arbitrary position is guided to the confined volume through the guidance duct and only then released into the container volume in a controlled manner through the controlled opening. Preferably, the duct forming component provides an annular guidance duct around a circumference of the contact area, which includes the at least one air vent valve at an angular position thereof.

Further, since the annular guidance duct is configured to collect the incoming air at the air vent valve independent from the annular position, i.e. a rotational position of the air vent valve, the assembly of the feeding bottle device gets facilitated since the location of the at least one air vent valve does not have to correspond to a particular location or orientation.

Teat component, attachment component and container component preferably correspond to similar components known in the context of a prior art feeding bottle device. For instance, the attachment component can comprise a screw-ring for attaching the teat component to the container component. In other embodiments, at least two components, such as teat component and attachment component for instance, can also be integrated within one component. In this embodiment, the integrated components are preferably manufactured through injection molding using two different materials having different material properties. Thereby, for instance, the teat can advantageously remain flexible while the attachment portion is less flexible for ensuring a secure attachment to the container component.

In an embodiment the at least one air vent valve is integrated in at least one of the teat component, the container component, the attachment component, the duct forming component, and an interface between any of these components. Since the teat component and the container component are attachable along a generally annular contact area, the contact area or an area in proximity to the contact area provides a preferred location for providing an air vent valve for allowing air from outside the feeding bottle device to enter the container volume. Further, since the attachment component is provided to attach the teat component to the container component, the air vent valve integrated therein will preferably also be provided in proximity to the contact area when the feeding bottle device is in an assembled state.

While the air vent valve is preferably integrated in at least one of the teat component, the container component, the attachment component, the duct forming component and an interface between any two of these components, it can also be provided at a separate position and/or with a dedicated component in other embodiments. It should be noted that the air vent valve can be provided in any form suitable for allowing the passage of air but preventing the passage of liquid, such as including a microhole construction which allows the passage of air, a check valve and the like.

In an embodiment the guidance duct is formed by the duct forming component and at least one of the teat component and the container component in an assembled state of the feeding bottle device.

Exemplarily, the opening of the container component and therefore the generally annular contact area can be defined to be in a horizontal plane. A then annular wall of the container component can therefore exemplarily extend in a substantial vertical direction. In known feeding bottle devices, the teat component forms a seal on an upper edge of the wall of the container component in an assembled state of the feeding bottle device, wherein the teat component at least partially extends vertically and horizontally around the annular contact area. Preferably, the duct forming component is in an assembled state of the feeding bottle device such arranged that the guiding duct be formed between the vertical wall of the container component, the horizontal portion of the teat component and the duct forming component. This allows for a simple design of the duct forming component and at the same time ensures that the contact area between teat component and container component, i.e. a likely area for the location of the at least one air vent valve, be contained within the guidance duct independent of the annular or rotational position of the air vent valve. Preferably, the guidance duct extends over the entire circumference of the contact area and thereby provides an annular guidance duct.

In an embodiment at least one component of the feeding bottle device comprises two solid materials with different material properties. For instance, this component can be manufactured using a 2K injection moulding process and allows to reduce the number of parts to be assembled, while maintaining the favourable different material properties. As an example, the teat component can advantageously be integrally formed with the attachment component, while both a flexibility of the teat component and a rigidity of the attachment component can be maintained.

In an embodiment the feeding bottle device further comprises a passage prevention component for preventing liquid from the confined volume to reach the at least one air vent valve. Since the controlled opening allows a fluid passage from the confined volume into the container volume, i.e. a passage of outside air entering via the air vent valve, it should be assured that fluid streaming in the opposite direction, i.e. milk or liquid within the container volume, does not leak from the air vent valve.

Due to the provision of the passage prevention component, fluid leaving from within the confined volume and/or the container volume through the annular guidance duct and the air vent valve is impeded, i.e. the feeding bottle device is less likely to leak. Further, since the passage prevention component is provided, liquid is prevented from reaching the air vent valve and thus the formation of bubbles all together can be reduced.

In an embodiment the passage prevention component comprises a one way valve between the guidance duct and the confined volume. As an alternative, a hole can be provided as a connection between the guidance duct and the confined volume, while a diameter of the hole is preferably set such that a passage of the less dense fluid, i.e. the outside air, be preferred to a passage of the fluid from within the container volume, e.g. milk, for instance.

In an embodiment the passage prevention component comprises a reservoir deflection between the guidance duct and the confined volume. In this embodiment, the reservoir deflection acts as a valve to prevent fluid, i.e. liquid, from reaching the air vent valve. Preferably, the reservoir deflection fills with liquid in case the feeding bottle device is positioned upside down such that no liquid leaks from the air vent valve. Further preferably, the volume of the reservoir deflection is larger than an expected volume of the liquid within the confined volume when the feeding bottle device is in a position with a teat of the teat component pointing vertically upwards.

In an embodiment the confined volume forming component is formed as an orientation indicator, wherein the orientation indicator is visible from outside the feeding bottle device when in an assembled state. Preferably, the orientation indicator is intended to be positioned upside the feeding bottle device when used for feeding, such that the confined volume, which corresponds to the position of the orientation indicator, will also be positioned upside. Thereby, the confined volume will already at a very early stage of feeding, i.e. while the container volume is still significantly filled, be on top of the liquid level, thereby further reducing the amount of air within the liquid to be fed to the infant. Preferably, the orientation indicator presents a color showing a good contrast versus milk.

In an embodiment the confined volume forming component and the duct forming component are integrated in a partitioning component for dividing the teat volume from the container volume when the feeding bottle device is assembled.

In an embodiment the partitioning component comprises a first passage allowing a passage of fluid from the container volume to the teat volume and a second passage allowing a passage of fluid from the teat volume to the container volume, wherein the second passage is provided in the form of a one-way passage. Thereby, the probability of air to reach the mouth of the infant can be reduced since it can be ensured that the teat volume be filled during a majority of the feed in all orientations. This even holds for a more horizontal orientation than usually achievable with known feeding bottle devices, which need to be provided with a significant vertical inclination. In some embodiments, also the first passage can be provided in the form of a one-way passage.

In an embodiment the second passage is closer to the confined volume forming component than the first passage. Since the second passage is configured to allow the passage of fluid, preferably air, only from the teat volume to the container volume and since the confined volume component is intended to be positioned upside the feeding bottle device when in a feeding position, the second passage is more likely to be positioned higher than a level of liquid within the container volume, thereby facilitating the removal of air from the teat volume.

In an embodiment the second passage opens into the guidance duct. Thereby, bubble formation is less likely to occur due to the guidance duct being connected with the container volume via the confined volume and the controlled opening.

In an embodiment the second passage protrudes from the partitioning component further into the container volume than the first passage. Thereby, entrance of liquid from the container volume into the teat volume is facilitated, while the removal of air from the teat volume through the second passage to the container volume is facilitated.

In an embodiment at least one of the first and second passage comprises a flap valve. While a flap valve is provided as an example, additionally or alternatively other valves, such as, without limitation, a duckbill valve, can be employed.

In an embodiment the partitioning component comprises a sealing material attached thereto for providing a hard-soft interface between the partitioning component and at least one of the teat component and the container component. For example, the container component can be harder than the teat component and the partitioning component can be approximately as hard as the container component. Accordingly, a softer sealing material provided at the interface between the container component and the partitioning component can allow a good sealing by providing a hard-soft interface therebetween. This is of course just an example and also a softer partitioning component, wherein a harder sealing material is provided attached thereto, can be employed in a different example. Further, in other embodiments the sealing material can also be integrated within the partitioning component, for instance.

It shall be understood that a preferred embodiment of the present invention can also be any combination of the dependent claims or above embodiments with the respective independent claim.

These and other aspects of the invention will be apparent from and elucidated with reference to the embodiments described hereinafter.

DETAILED DESCRIPTION OF EMBODIMENTS

Figure 1:
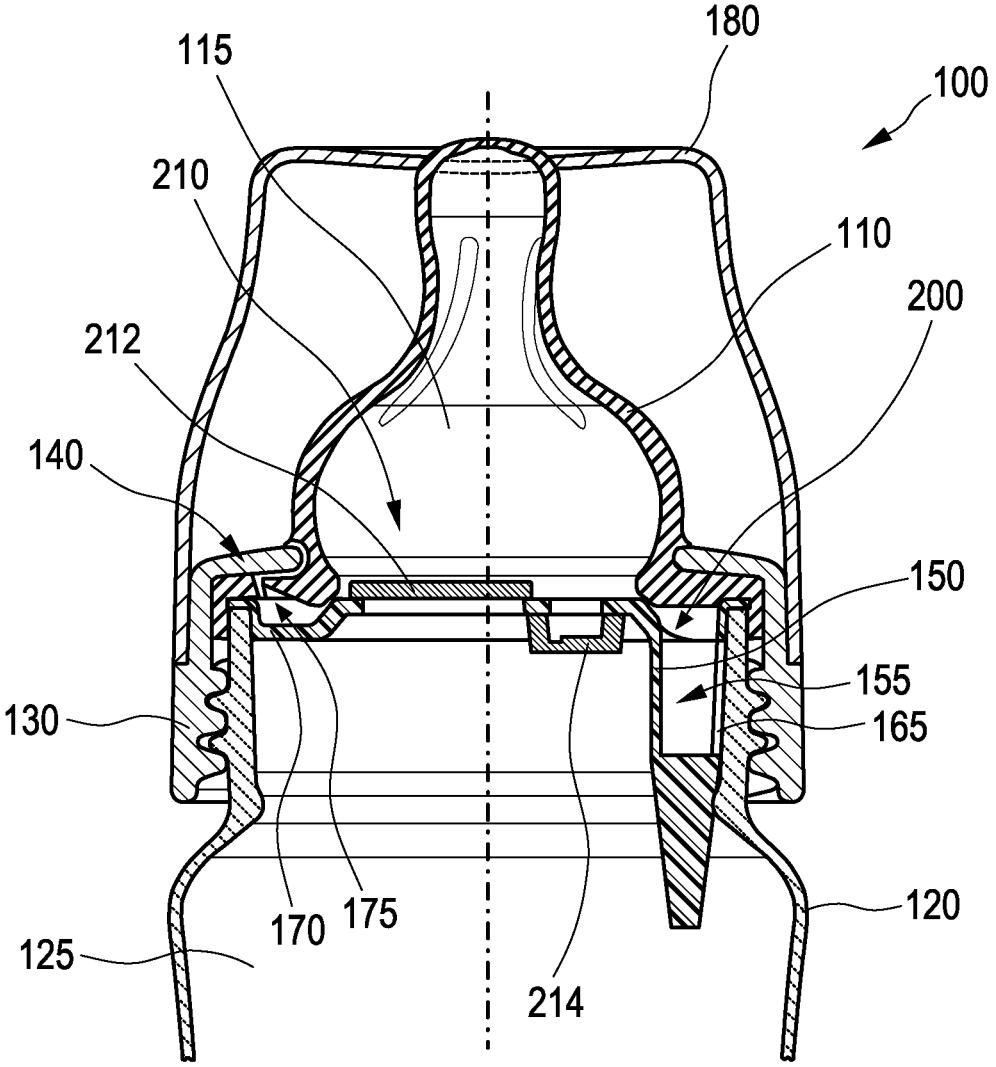
FIG. 1 shows schematically and exemplarily a feeding bottle device according to the invention.
Figure 5:
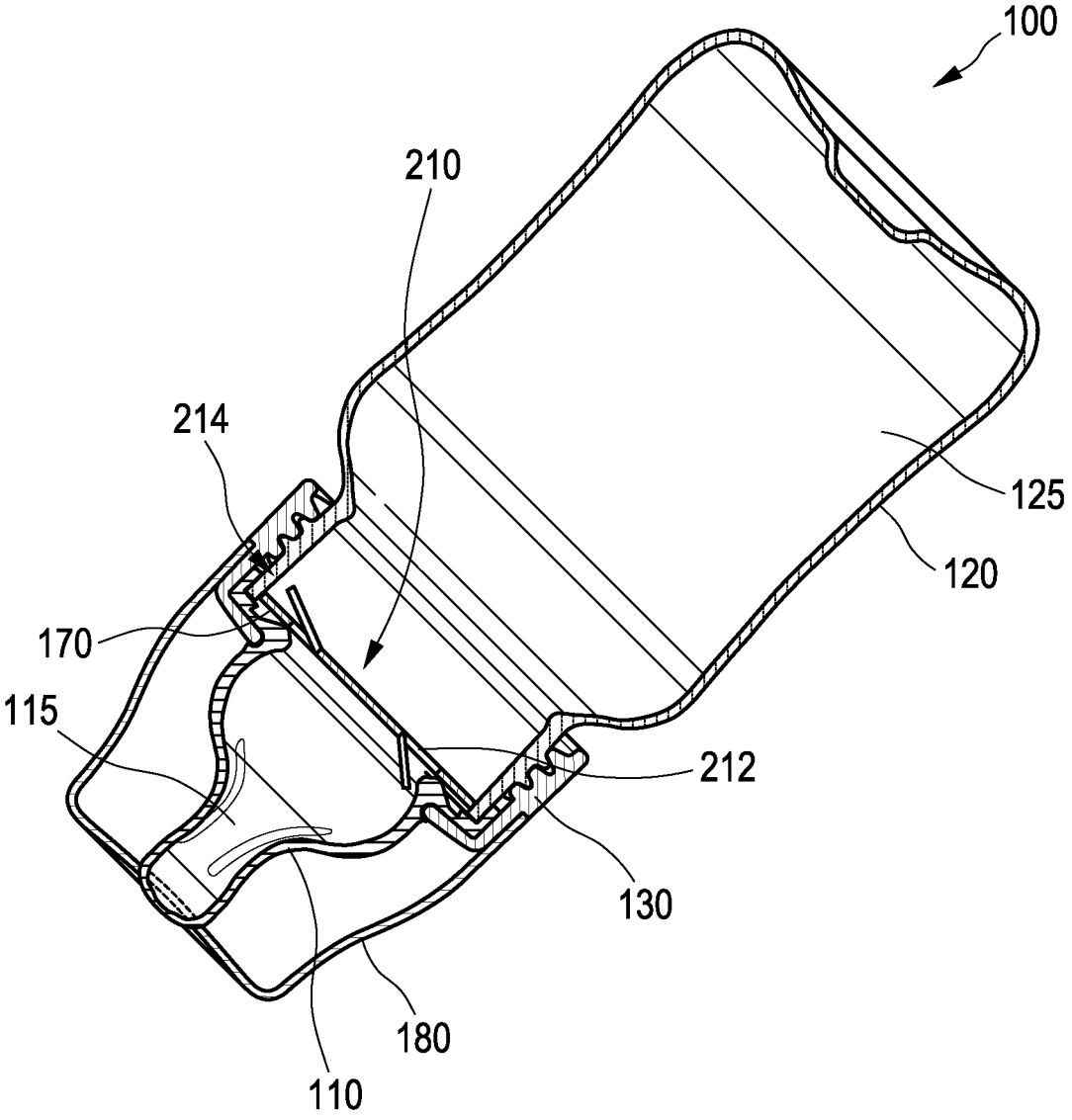
FIG. 5 shows schematically and exemplarily an orientation of the feeding bottle device in a feeding position.

FIG. 1 shows schematically and exemplarily a feeding bottle device 100 in an assembled state in cross-sectional view. Feeding bottle device 100 comprises a teat component 110, which is attached to a container component 120 by means of an attachment component 130 in the form of a locking ring. Usually, feeding bottle device 100 and more precisely a container volume 125 within container component 120 is filled with milk, which is then fed to an infant out of teat component 110. For this purpose, feeding bottle device 100 in the assembled state illustrated in FIG. 1 is maintained at an angle which allows milk to enter the teat volume 115 within teat component 110, as also illustrated in FIG. 5.

In the attachment area between teat component 110, container component 120 and attachment component 130, an air vent valve 140 for allowing air from outside of feeding bottle device 100 to enter into container volume 125 is provided. Thereby, the vacuum present in teat volume 115 while the infant is suckling to feed milk can be reduced, without air having to enter through a teat hole of teat component 110. Air entering through teat component 110 increases the risk of air being present within teat volume 115 and eventually entering the infant's mouth. Various forms of air vent valves 140 are known in the art, and can be, for instance, integrated within teat component 110, container component 120 and/or attachment component 130 in proximity to the attachment area. In other examples the air vent valve 140 can also be provided at a different location, such as integrated within teat component 110 or container component 120 distant from the attachment area.

Air enters through air vent valve 140 and gets collected in guidance duct 175 prior to entering container volume 125. Guidance duct 175 is in this example formed annularly around the attachment area, collects the air independent of an angular position of air vent valve 140 and guides it towards a confined volume 155. Adjacent to or as part of confined volume 155, a controlled opening 165 for releasing air into container volume 125 is provided. For this purpose, a duct forming component 170 extends annularly around an opening of container volume 125 and defines annular guidance duct 175 between duct forming component 170, container component 120 and/or teat component 110. It should be noted that guidance duct 175 is not necessarily to be provided in annular form around the opening of container volume 125, for instance, in case the angular position of air vent valve 140 is well known such as in a "must fit" layout, in which guidance duct 175 collects the air always at the same defined position of air vent valve 140.

The exemplary shape of the guidance duct 175 of FIG. 1 is of course not the only feasible shape, other shapes of guidance duct 175 are contemplated in other examples. It is only of importance that guidance duct 175 be capable of connecting air entering through air vent valve 140 and guiding this air to confined volume 155.

In this example, confined volume 155 is defined by a confined volume forming component 150, which is provided adjacent a wall of container component 120. The confined volume 155 is thereby limited by confined volume forming component 150 and container component 120. In other examples, confined volume 155 can also be defined by confined volume forming component 150 only.

Between annular guidance duct 175 and confined volume 155, there is an optional passage prevention component 200 provided, which prevents the passage of liquid from container volume 125 towards air vent valve 140. Thereby, leaking of the feeding bottle device 100 can be prevented. Generally, in case liquid reaches air vent valve 140, the formation of bubbles is increased. It is therefore advantageous to not have any liquid in proximity of air vent valve 140. In one example, a one way valve can be provided as passage prevention component 200, which then prevents liquid from reaching air vent valve 140 and guidance duct 175 under typical use of feeding bottle device 100. However, also other suitable arrangements for preventing the passage of liquid from container volume 125 to air vent valve 140 can be employed in the alternative.

Figure 2:
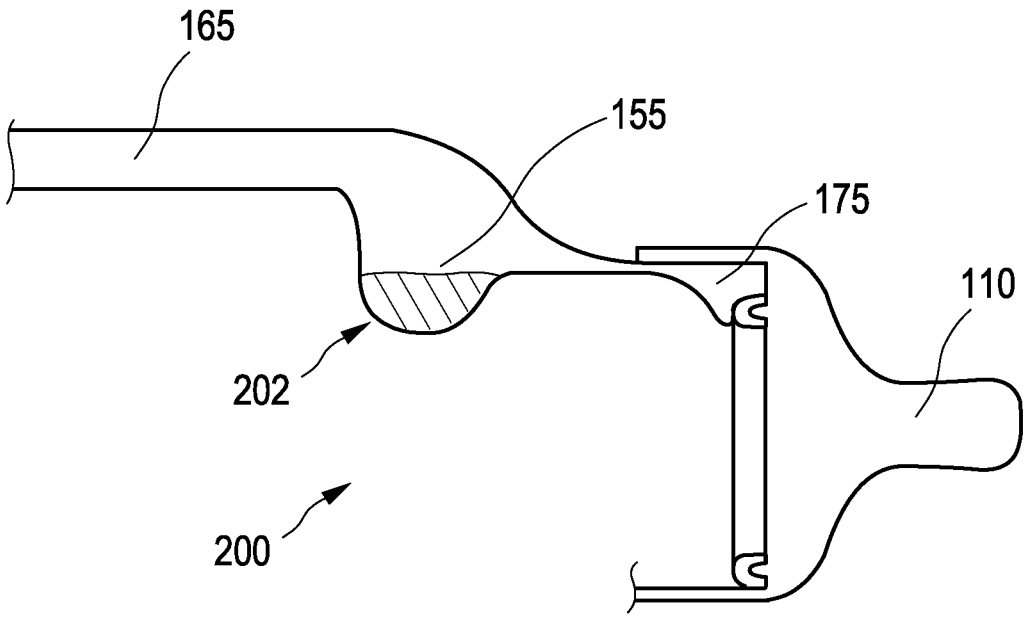
FIG. 2 shows schematically and exemplarily a reservoir deflection as a passage prevention component.

For example, another passage prevention component 200 is illustrated with reference to FIG. 2. FIG. 2 schematically and exemplarily illustrates a reservoir deflection 202 as passage prevention component 200. Reservoir deflection 202 forms a sufficiently large volume to trap any present liquid in the confined volume 155 and prevent it from reaching air vent valve 140. It is preferred that the volume of the reservoir formed by reservoir deflection 202 be larger than the expected volume of liquid within confined volume 155 when feeding bottle device 100 is in a resting position with teat component 110 pointing vertically upwards.

Returning to the example of FIG. 1, confined volume forming component 150 and duct forming component 170 are integrated within a partitioning component 210 for separating container volume 125 from teat volume 115. In the example, partitioning component 210 fits between an opening of container component 120 and teat component 110 and creates two interfaces, one to each of the two components. Preferably, partitioning component provides a hard interface towards teat component 110 and a soft interface towards container component 120 to overcome leakage issues even though there is an additional part, partitioning component 210, present in the attachment area. Further, torsional strength of the assembly of attachment component 130, in particular in case it is formed as a screw ring, is not impacted. For this reason, partitioning component 210 may be manufactured using 2K injection molding processes, for instance. In other examples, partitioning component 210 may comprise a sealing material attached thereto which ensures the hard-soft interfaces between teat component 110, partitioning component 210 and container component 120, respectively.

Partitioning component 210 comprises a first passage 212 for allowing the passage of liquid from container volume 125 and a second passage 214 for allowing the passage of air from teat component 115 to container volume 125. It is preferred that at least the second passage 214 comprises a one-way passage, such as a one-way valve, which allows a passage from teat component 115 to container volume 125 only.

An exemplary partitioning component 210 is schematically and exemplarily shown in further detail in FIG. 3, the operation of the first passage 212 and second passage 214 will be described below with reference to FIG. 5.

Figure 3:
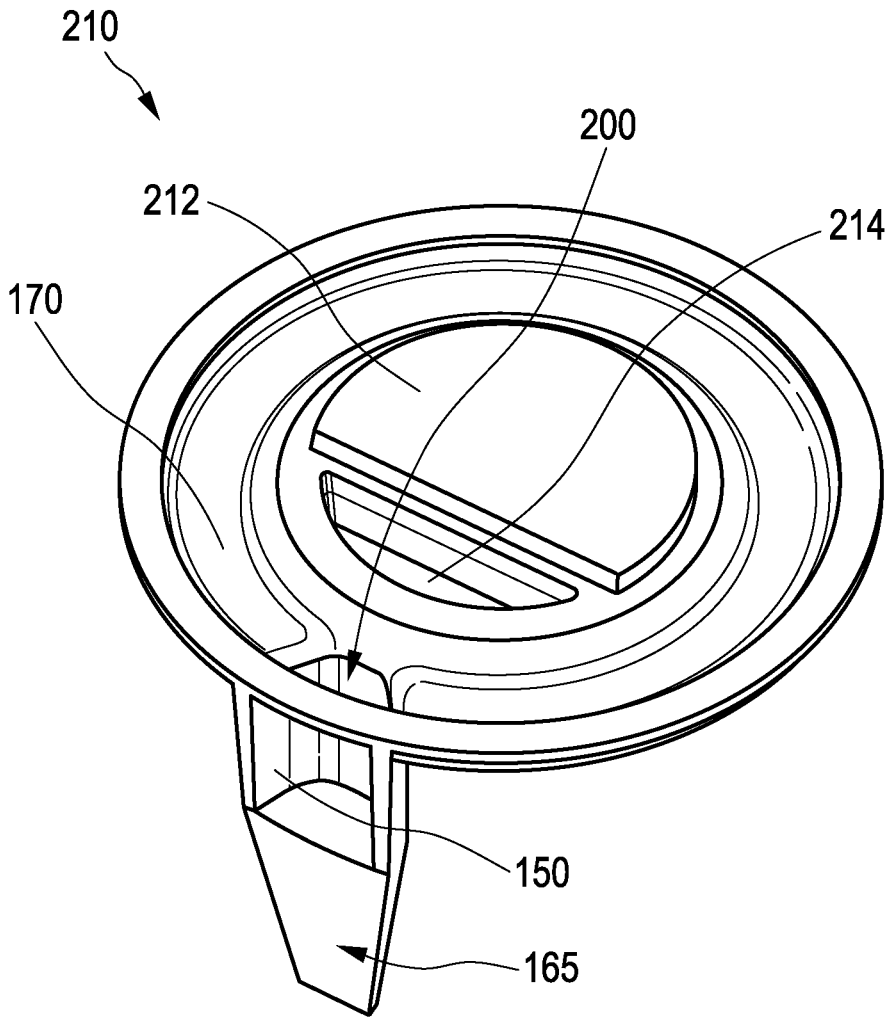
FIG. 3 shows schematically and exemplarily a partitioning component.

FIG. 3 illustrates particularly duct forming component 170 opening into confined volume forming component 150 through a passage prevention component 200. In the example of FIG. 3, first passage 212 and second passage 214 are formed as oppositely directed flap valves having respective hinge axes parallel to each other.

Figure 4A:
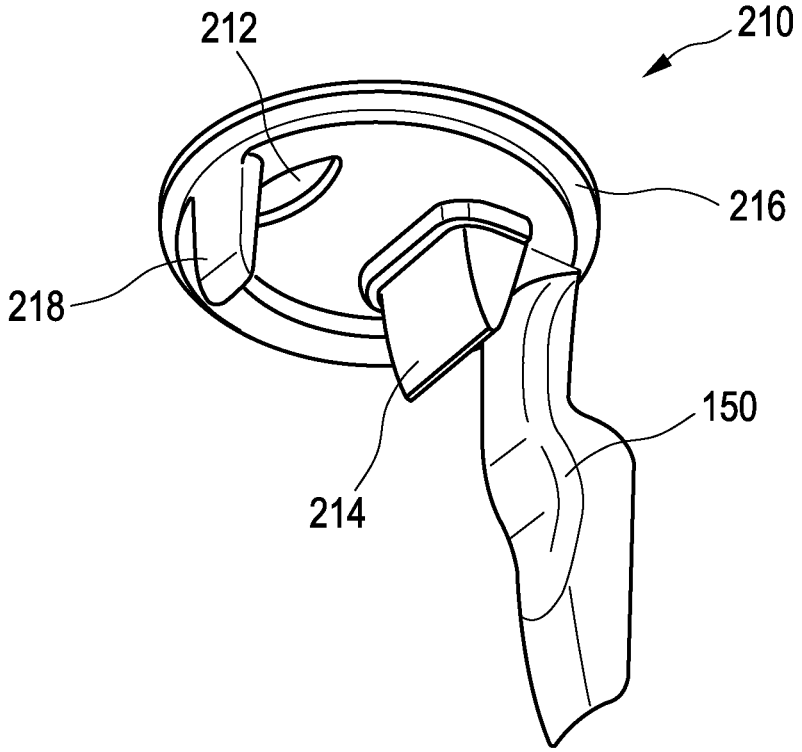
FIG. 4A shows schematically and exemplarily a further partitioning component in isolation.
Figure 4B:
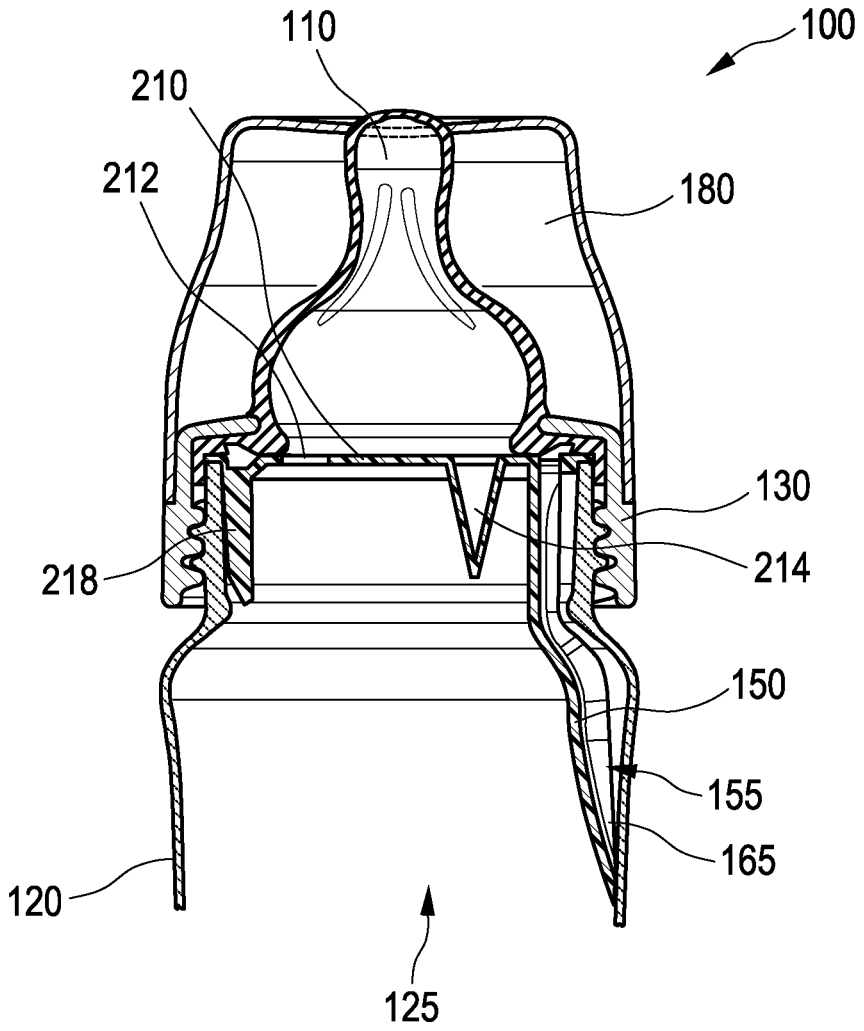
FIG. 4B shows schematically and exemplarily the partitioning component of FIG. 4A in an assembled state of the feeding bottle device.

Another example of partitioning component 210 is schematically shown in FIGS. 4A and 4B. While FIG. 4A illustrates partitioning component 210 in isolation, FIG. 4B illustrates the partitioning component 210 in an assembled state of feeding bottle device 100.

In this example, first passage 212 is formed as an opening with an exemplary elongated ellipsoidal shape in partitioning component 210. Second passage 214 comprises a duckbill valve which allows the passage of fluid, in particular air, from teat volume 115 to container volume 125 but blocks the passage of fluid in the opposite direction. The shape of the opening can of course be as desired.

Further, partitioning component 210 comprises a sealing material 216 at an interface to container component 120 in an assembled state. Sealing material 216 can integrally be formed with partitioning component 210 or be attached to partitioning component at a later stage and preferably comprise a soft material such that a sealing will be formed between container component 120 and partitioning component 210 after assembly of feeding bottle device 100. Likewise, the interface to teat component 110 preferably comprises a harder material such that also the interface between teat component 110 and partitioning component 210 will not leak.

A guiding component 218 having an exemplary tapered shape facilitates the assembly of partitioning component 210 into container component and provides a resistance against spring force from confined volume forming component 150, which comprises a flexible silicone for instance, pressing against the wall of container component 120.

In FIG. 4B confined volume 155 as defined between confined volume forming component 150 and a wall of container component 120 is clearly visible. Controlled opening 165 is formed at the portion of confined volume 155 which has the largest distance from teat component 110.

Returning to FIG. 1, a cap 180 covering teat component 110 and at least partly attachment component 130 is illustrated. During assembly, in general, teat component 110 is inserted within attachment component 130 from the, as drawn in FIG. 1, lower side thereof. Then, cap 180 is attached over attachment component 130 to keep germs or other unwanted substances away from the usually sterilized teat component 110. Then, the assembly of attachment component 130, teat component 110 and cap 180 is attached, for instance screwed, on container component 120, into which already partitioning component 210 has been inserted. Of course, these assembly steps are only exemplary. In other examples, teat component 110 and attachment component 130 can be integrally provided as one component, which can then preferably be formed through molding using two materials having different material properties, in particular two different flexibilities.

FIG. 5 schematically and exemplarily illustrates feeding bottle device 100 in an operating position, in which feeding bottle device 100 is inclined such that teat component 110 points downwards at a certain angle such that liquid enters teat volume 115. First passage 212 is at the lower position, i.e. significantly below the liquid level during most of the feeding session, such that liquid can enter through first passage 212 into teat volume which will always be essentially filled with liquid.

While usually the vacuum applied by the sucking action of the infant results in liquid being drawn into teat volume 115 through first passage 212, air entering into teat volume 115 through an opening of teat component 110 will also occur, for instance when the infant releases the latch. This air should not be ingested by the infant, which is the reason for second passage 214 being provided. Through second passage 214, which is formed in the form of a one-way passage, air can escape from teat volume 115 into container volume 125 but no fluid can pass from container volume 125 into teat volume 115. Since second passage 214 is located higher with respect to first passage 212 in the operating position illustrated in FIG. 5, it is more likely that second passage 214 be positioned above the level of liquid in container volume 125 such that no bubbles form when air enters into container volume 125 through second passage 214. The provision of first and second passages thereby results in less likelihood of air being ingested by the infant. In this example, both first 212 and second 214 passages are provided as flap valves, while other passages including duckbill valves or even openings can be employed in other examples. Preferably, in case both passages comprise valves, both first 212 and second 214 valves have a very low or no opening pressure, i.e. are nominally open, and further preferably also have a very low closing pressure. For instance, the opening pressure of the valves is preferably 10 mbar or less.

Figure 6A:
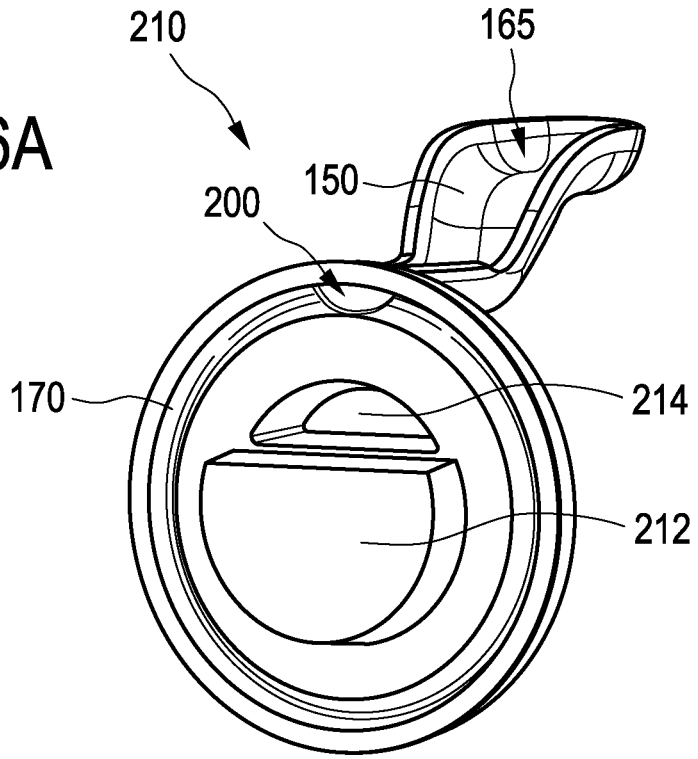
FIGS. 6A and 6B show schematically and exemplarily two perspective views on a partitioning component to be used with the invention.
Figure 6B:
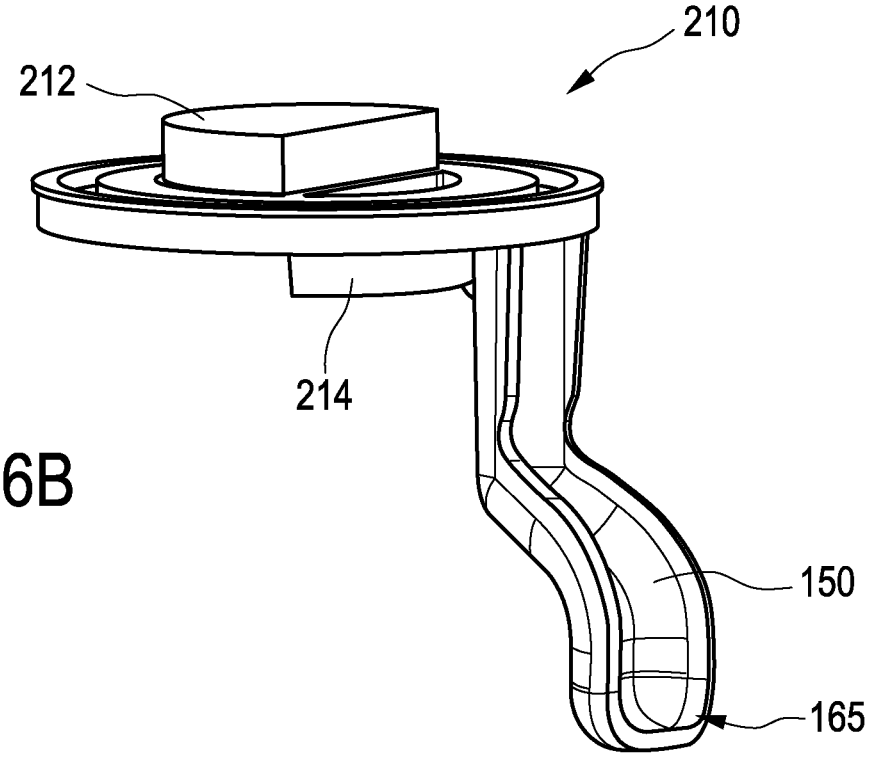

FIGS. 6A and 6B show two exemplary perspective views on partitioning component 210, wherein the reference numbers correspond to the other examples described herein above. While first passage 212 is generally larger than second passage 214, the invention is not limited thereto. Further, first passage 212 comprises a flap valve and protrudes in this example from partitioning component 210 towards the teat volume 115 side, and second passage 214 comprises a further flap valve and protrudes from partitioning component 210 towards the container volume 125 side, to which the invention is also not limited.

Confined volume forming component 150 can act as an orientation indicator, i.e. be visible from the outside of feeding bottle device 100, such that the user knows the correct upside orientation of feeding bottle device 100 when the device is in use. For this reason, as can well be seen in FIGS. 6A and 6B, second passage 214 is closer to the confined volume forming component 150 than first passage 212 and will therefore more probably be above the liquid level throughout the feeding.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit, component or device may fulfill the functions of several items recited in the claims. The mere fact that certain measures are recited in mutually different dependent claims does not indicate that a combination of these measures cannot be used to advantage.

Accordingly, a feeding bottle device 100 is presented, comprising a confined volume forming component 150 for defining a confined volume 155 within a container volume 125 of the feeding bottle device 100, wherein the confined volume 155 provides a controlled opening 165 into the container volume 125, and an optional duct forming component 170 for forming a guidance duct 175 from the at least one air vent valve 140, which allows the passage of air from outside to the inside of feeding bottle device 100, to the confined volume 155. The feeding bottle device 100 reduces the risk of colic-like symptoms for an infant.

The invention claimed is:

1. A feeding bottle device, the feeding bottle device comprising a teat component defining a teat volume therein, a container component defining a container volume therein, and an attachment component, the teat component and the container component being attachable to each other along a contact area by means of the attachment component, the feeding bottle device further comprising:

at least one air vent valve for allowing the passage of air from outside the feeding bottle device to within the container volume when the feeding bottle device is assembled, a confined volume forming component for defining a confined volume within the container volume, wherein the confined volume is configured to provide a controlled opening for air entering through the air vent valve into the container volume, wherein the confined volume is formed by the confined volume forming component and a wall of the container volume in an assembled state of the feeding bottle device.

2. The feeding bottle device according to claim 1, further comprising a duct forming component for forming a guidance duct from the at least one air vent valve to the confined volume.

3. The feeding bottle device according to claim 1, wherein the at least one air vent valve is integrated in at least one of the teat component, the container component, the attachment component, the duct forming component, and an interface between any of these components.

4. The feeding bottle device according to claim 2, wherein the guidance duct is formed by the duct forming component and at least one of the teat component the container component in an assembled state of the feeding bottle device.

5. The feeding bottle device according to claim 1, wherein at least one component of the feeding bottle device comprises two solid materials with different material properties.

6. The feeding bottle device according to claim 1, further comprising a passage prevention component for preventing liquid from the confined volume to reach the at least one air vent valve.

7. The feeding bottle device according to claim 2, wherein the passage prevention component comprises a one way valve between the guidance duct and the confined volume.

8. The feeding bottle device according to claim 2, wherein the passage prevention component comprises a reservoir deflection between the guidance duct and the confined volume.

9. The feeding bottle device according to claim 1, wherein the confined volume forming component is formed as an orientation indicator, wherein the orientation indicator is visible from outside the feeding bottle device when in an assembled state.

10. The feeding bottle device according to claim 2, wherein the confined volume forming component and the duct forming component are integrated in a partitioning component for dividing the teat volume from the container volume when the feeding bottle device is assembled.

11. The feeding bottle device according to claim 10, wherein the partitioning component comprises a first passage allowing a passage of fluid from the container volume to the teat volume and a second passage allowing a passage of fluid from the teat volume to the container volume, wherein the second passage is provided in the form of a one-way passage.

12. The feeding bottle device according to claim 11, wherein the second passage is closer to the confined volume forming component than the first passage.

13. The feeding bottle device according to claim 11, wherein at least one of the first and second passage comprises a flap valve or a duckbill valve.

14. The feeding bottle device according to claim 10, wherein the partitioning component comprises a sealing material attached thereto for providing a hard-soft interface between the partitioning component and at least one of the teat component and the container component.

* * * * *